US008567100B1

(12) United States Patent
Kopecky

(10) Patent No.: US 8,567,100 B1
(45) Date of Patent: Oct. 29, 2013

(54) EVENT REMINDER SYSTEM

(76) Inventor: Diana Kopecky, McKinney, TX (US)

( * ) Notice: Subject to any disclaimer, the term of this patent is extended or adjusted under 35 U.S.C. 154(b) by 0 days.

(21) Appl. No.: 12/661,093

(22) Filed: Mar. 10, 2010

Related U.S. Application Data

(60) Provisional application No. 61/210,091, filed on Mar. 13, 2009.

(51) Int. Cl.
*G09D 3/08* (2006.01)

(52) U.S. Cl.
USPC ..... 40/115; 116/308; 116/309; 116/316; 116/318; 434/304

(58) Field of Classification Search
USPC ..... 40/115; 235/78 R, 83, 84; 273/141 R; 116/308, 309, 316, 318; 434/304
See application file for complete search history.

(56) References Cited

U.S. PATENT DOCUMENTS

| | | | | |
|---|---|---|---|---|
| 1,211,737 | A * | 1/1917 | Martini | 116/308 |
| 1,759,080 | A * | 5/1930 | Youngblodt | 116/308 |
| 1,971,854 | A * | 8/1934 | Gould | 40/107 |
| 3,648,025 | A * | 3/1972 | Adams | 235/83 |
| 5,694,882 | A * | 12/1997 | Marshall | 116/311 |
| 7,658,162 | B2 * | 2/2010 | Kreshek | 116/311 |
| 2007/0056503 | A1 * | 3/2007 | Sollaccio | 116/308 |
| 2009/0293798 | A1 * | 12/2009 | Kreshek | 116/308 |

* cited by examiner

*Primary Examiner* — Gary Hoge

(57) ABSTRACT

A hub is formed with a lower extent having a first diameter, an intermediate extent having a second diameter, and a circular upper extent having a third diameter. A circular disk has an upper surface with indicia, a lower surface with an attachment component, and a hole with a diameter essentially equal to the second diameter for being received by the hub. A pointer has a first free end and a first securement ring having an interior diameter essentially equal to the third diameter and an exterior diameter essentially equal to the second diameter. The first securement ring is in sliding contact with the intermediate extent of the hub.

1 Claim, 6 Drawing Sheets

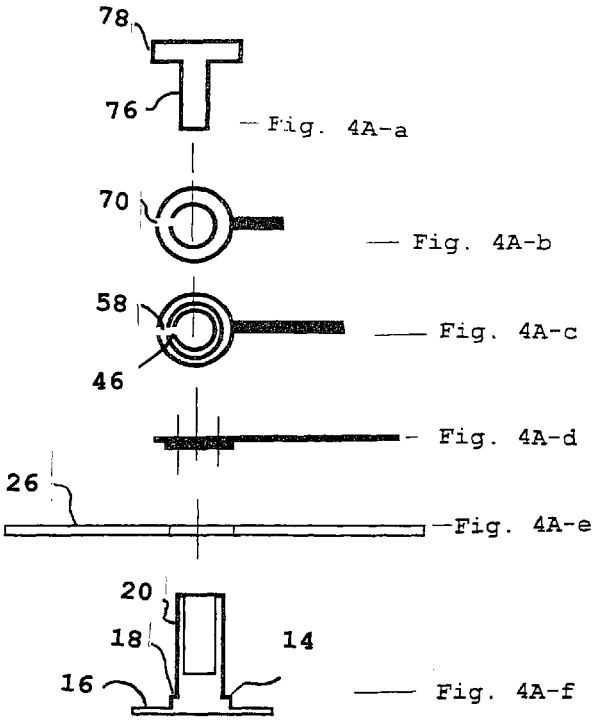
78
76
Fig. 4A-a
70
Fig. 4A-b
58
Fig. 4A-c
46
Fig. 4A-d
26
Fig. 4A-e
20
18
14
16
Fig. 4A-f
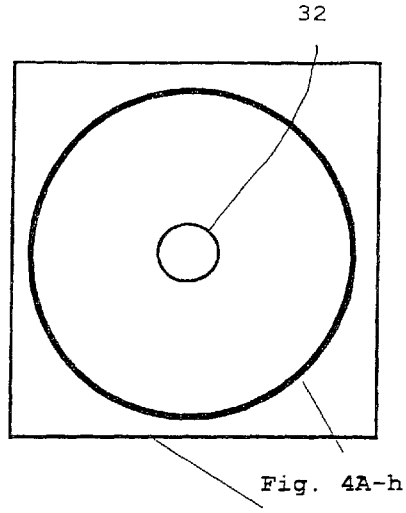
32
Fig. 4A-h
Fig. 4A-g
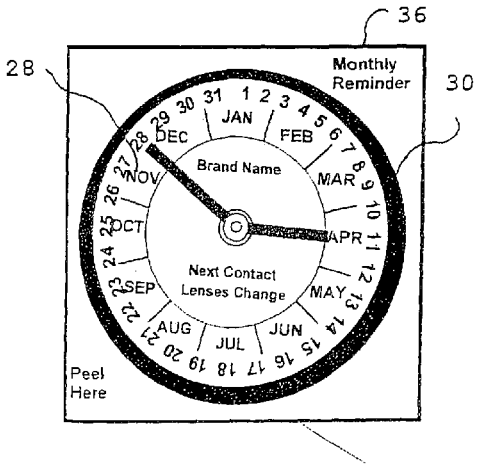
36
28
30
Monthly Reminder
Brand Name
Next Contact Lenses Change
JAN
FEB
MAR
APR
MAY
JUN
JUL
AUG
SEP
OCT
NOV
DEC
Peel Here
Fig. 4A-i
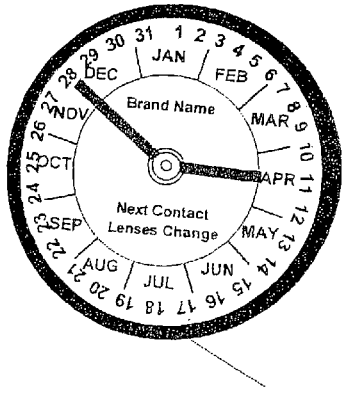
Brand Name
Next Contact Lenses Change
JAN
FEB
MAR
APR
MAY
JUN
JUL
AUG
SEP
OCT
NOV
DEC
Fig. 4A-j

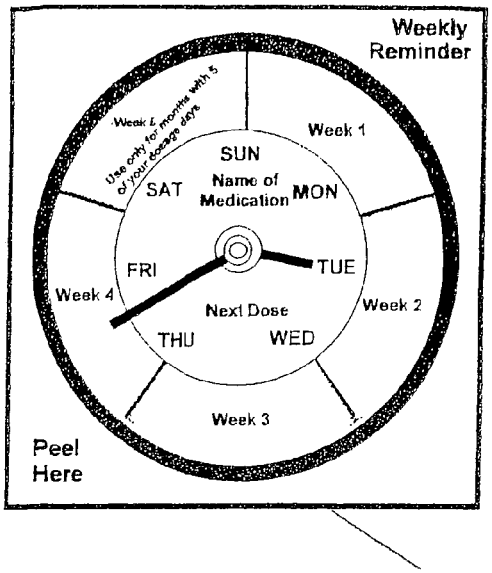
Fig. 5A-a
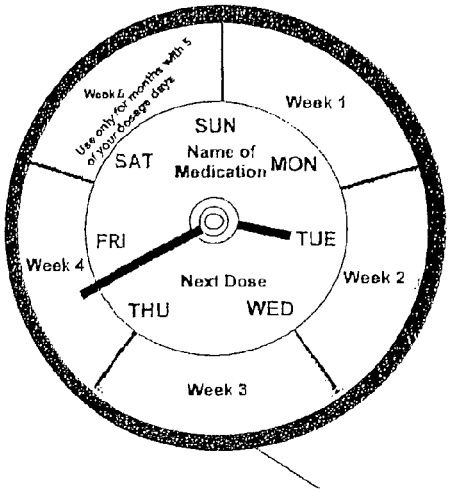
Fig. 5-b
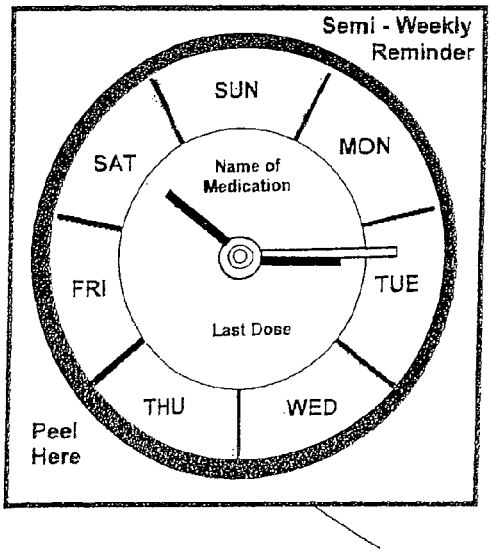
Fig. 6A-a
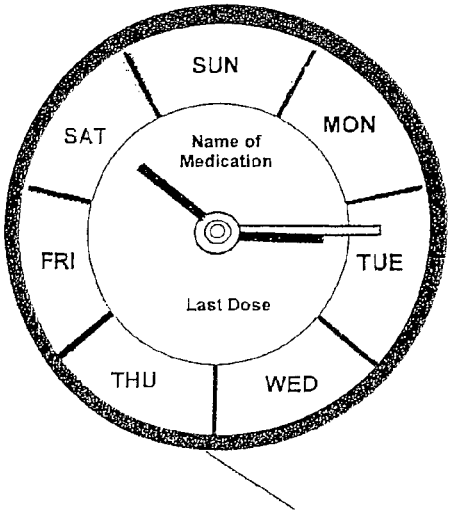
Fig. 6A-b

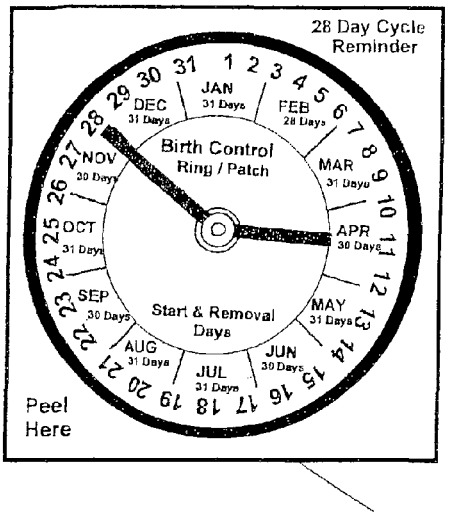
Fig. 7A-a
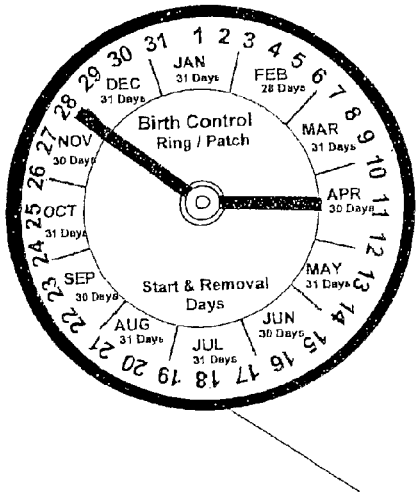
Fig. 7A-b
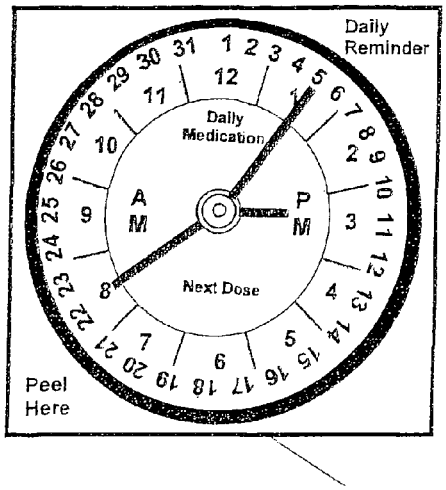
Fig. 8A-a
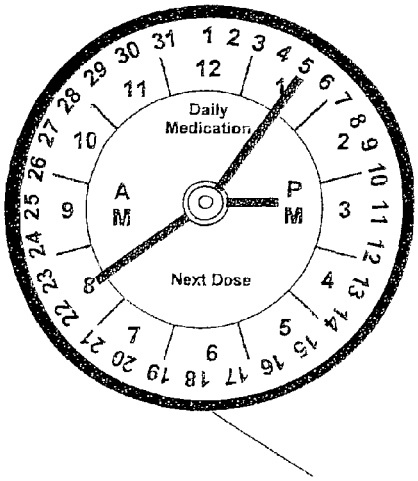
Fig. 8A-b

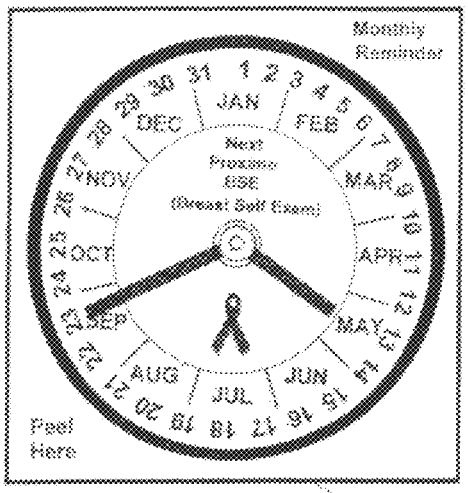
Fig. 9A-a
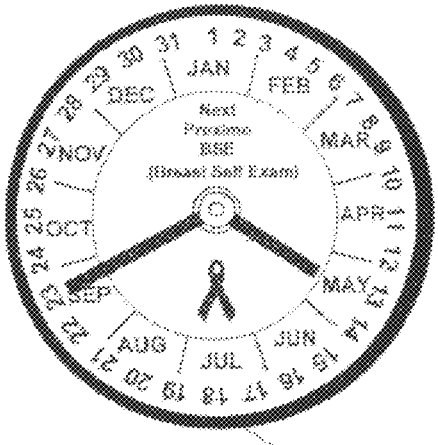
Fig. 9A-b
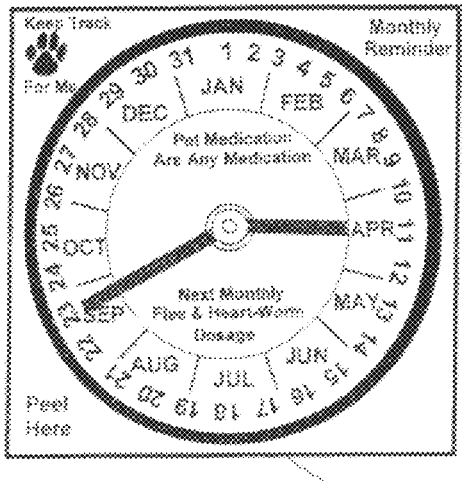
Fig. 10A-a
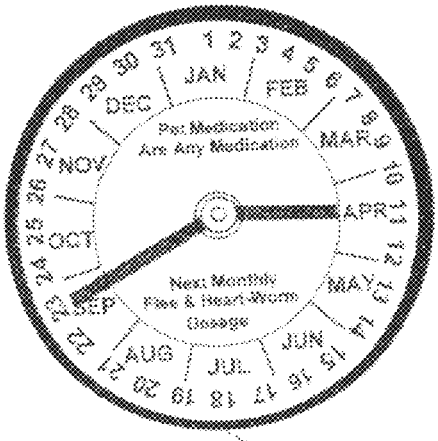
Fig. 10A-b

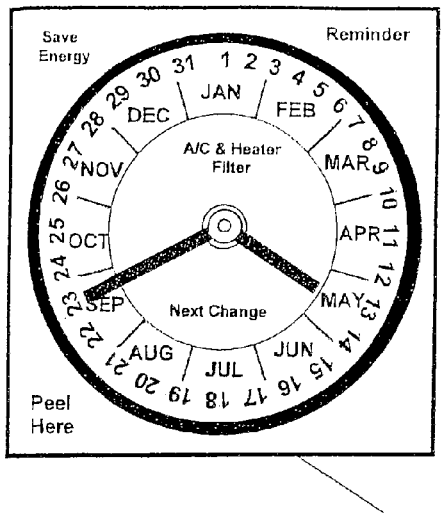
Fig. 11A-a
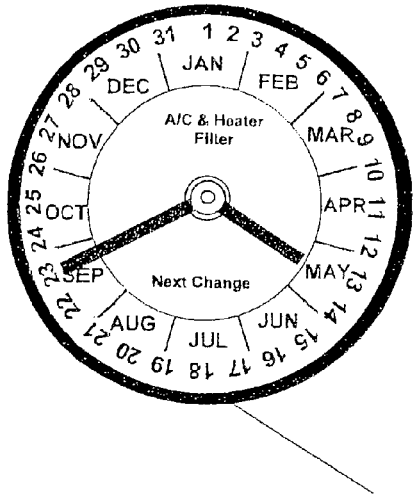
Fig. 11A-b
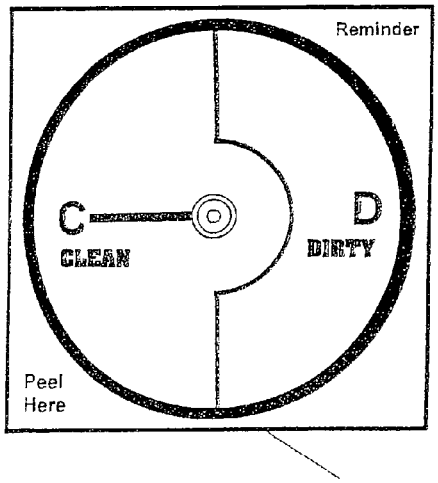
Fig. 12A-a
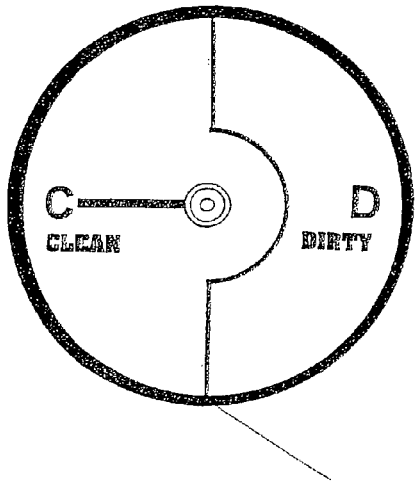
Fig. 12A-b

EVENT REMINDER SYSTEM

RELATED APPLICATION

The present non-provisional application is based upon pending Provisional Patent Application No. 61/210,091 filed Mar. 13, 2009, the subject matter of which application is incorporated herein by reference.

BACKGROUND OF THE INVENTION

1. Field of the Invention

The present invention relates to an event reminder system and more particularly pertains to reminding a user of the time for an upcoming event, the reminding being done in a safe, reliable, convenient and economical manner.

2. Description of the Prior Art

The use of event reminder systems of known designs and configurations is known in the prior art. More specifically, event reminder systems of known designs and configurations previously devised and utilized for the purpose of reminding a user of an upcoming event are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe an event reminder system that allows reminding a user of the time for an upcoming event, the reminding being done in a safe, reliable, convenient and economical manner.

In this respect, the event reminder system according to the present invention substantially departs from the conventional concepts and designs of the prior art, and in doing so provides an apparatus primarily developed for the purpose of reminding a user of the time for an upcoming event, the reminding being done in a safe, reliable, convenient and economical manner.

Therefore, it can be appreciated that there exists a continuing need for a new and improved event reminder system which can be used for reminding a user of the time for an upcoming event, the reminding being done in a safe, reliable, convenient and economical manner. In this regard, the present invention substantially fulfills this need.

SUMMARY OF THE INVENTION

In view of the foregoing disadvantages inherent in the known types of event reminder systems of known designs and configurations now present in the prior art, the present invention provides an improved event reminder system. As such, the general purpose of the present invention, which will be described subsequently in greater detail, is to provide a new and improved event reminder system and method which has all the advantages of the prior art and none of the disadvantages.

To attain this, the present invention essentially comprises a cylindrical hub. The hub is formed with a circular lower extent having a first diameter. The hub is also formed with a circular intermediate extent having a second diameter less than the first diameter. The hub is further formed with a circular upper extent having a third diameter less than the second diameter. A downwardly extending cylindrical hole is formed in the upper extent of the hub. The hub and the hole have a common central axis.

Next provided is a circular disk. The circular disk has an upper surface with indicia. The circular disk also has a lower surface with a securement component. The securement component is chosen from the class of securement components including adhesives and magnets. The circular disk has a hole with a diameter essentially equal to the second diameter for being received by the hub with the lower surface of the disk on the lower extent of the hub.

A square backing sheet is next provided. The backing sheet removably receives the disk. The securement component secures the disk to the sheet until separated by a user. The securement component is then adapted to temporarily secure the disk to a recipient surface, such as an air-conditioner, a refrigerator, a bathroom mirror, a notebook or the like.

Next, a first pointer is provided. The first pointer has a first exterior free end and a first interior securement ring. The free end and the first interior securement ring are separated by a first length. The first interior securement ring has an interior diameter essentially equal to the third diameter. The first interior securement ring has an exterior diameter essentially equal to the second diameter. The first interior securement ring is in sliding contact with the intermediate extent of the hub. The first interior securement ring has a first radial slot to facilitate positioning and rotation of the first pointer.

Next, a second pointer is provided. The second pointer has a second exterior free end and a second interior securement ring. The second exterior free end and the second interior securement ring are separated by a second length which is less than the first length. The second interior securement ring has an interior diameter essentially equal to the third diameter. The second interior securement ring has an exterior diameter essentially equal to the second diameter. The second securement ring has a downwardly extending cylindrical projection in sliding contact with the first pointer. The second securement ring has a second radial slot to facilitate positioning and rotation of the second pointer.

Next, a third pointer is provided. The third pointer has a third exterior free end and a third interior securement ring. The third exterior free end and the third interior securement ring are separated by a third length which is less than the second length. The third interior securement ring has an interior diameter essentially equal to the third diameter. The third interior securement ring has an exterior diameter essentially equal to the second diameter. The third securement ring has a downwardly extending cylindrical projection in sliding contact with the second pointer. The third securement ring has a third radial slot to facilitate positioning and rotation of the third pointer.

Lastly, a keeper pin is provided. The keeper pin has a cylindrical lower section frictionally received in the cylindrical hole of the hub. The keeper pin also has an enlarged shoulder with a diameter essentially equal to the exterior diameter of the third securement ring.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved event reminder system which has all of the advantages of the prior art event reminder systems of known designs and configurations and none of the disadvantages.

It is another object of the present invention to provide a new and improved event reminder system which may be easily and efficiently manufactured and marketed.

It is further object of the present invention to provide a new and improved event reminder system which is of durable and reliable constructions.

An even further object of the present invention is to provide a new and improved event reminder system which is susceptible of a low cost of manufacture with regard to both materials and labor, and which accordingly is then susceptible of low prices of sale to the consuming public, thereby making such event reminder system economically available to the buying public.

Even still another object of the present invention is to provide an event reminder system for reminding a user of the time for an upcoming event, the reminding being done in a safe, reliable, convenient and economical manner.

Lastly, it is an object of the present invention to provide a new and improved event reminder system having a hub formed with a lower extent having a first diameter, an intermediate extent having a second diameter, and a circular upper extent having a third diameter. A circular disk has an upper surface with indicia, a lower surface with an attachment component, and a hole with a diameter essentially equal to the second diameter for being received by the hub. A pointer has a first free end and a first securement ring having an interior diameter essentially equal to the third diameter and an exterior diameter essentially equal to the second diameter. The first securement ring is in sliding contact with the intermediate extent of the hub.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 4A through 4J are plan views of the components of the embodiments of the prior Figures.

FIGS. 5A through 12A are plan views of various additional embodiments of the invention.

The same reference numerals refer to the same parts throughout the various Figures.

DESCRIPTION OF THE PREFERRED EMBODIMENT

Figure 1:
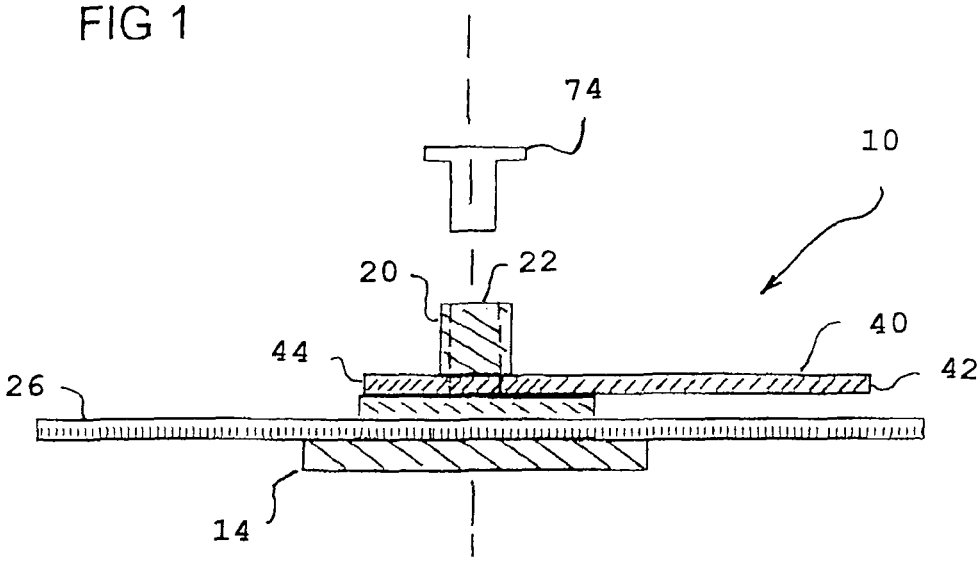
FIGS. 1, 2 and 3 are cross sectional views of three event reminder systems constructed in accordance with the principles of the present invention.
Figure 2:
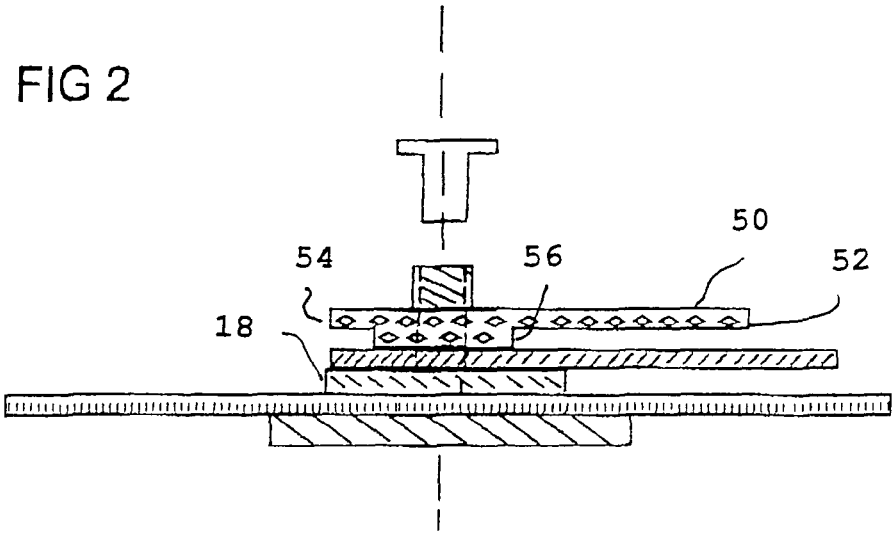
Figure 3:
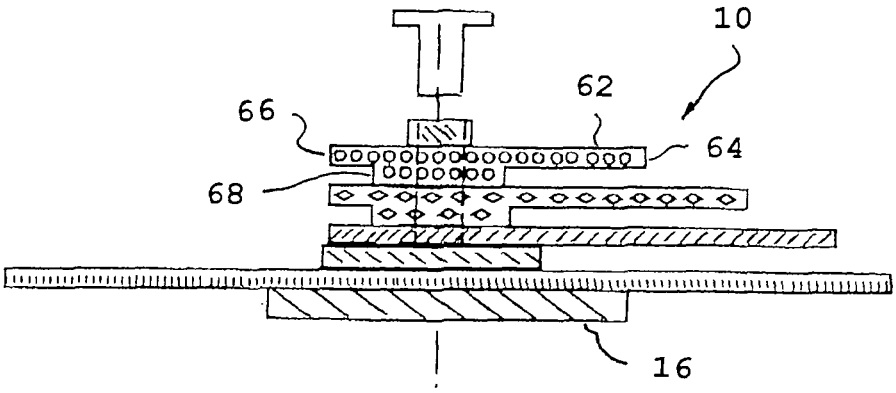

With reference now to the drawings, and in particular to FIG. 1 thereof, the preferred embodiment of the new and improved event reminder system embodying the principles and concepts of the present invention and generally designated by the reference numeral 10 will be described.

The present invention, the event reminder system 10 is comprised of a plurality of components. Such components in their broadest context include a hub, a circular disk and a pointer. Such components are individually configured and correlated with respect to each other so as to attain the desired objective.

The event reminder system 10 is for reminding a user of the time for an upcoming event. The reminding is done in a safe, reliable, convenient and economical manner. First provided is a cylindrical hub 14. The hub is formed with a circular lower extent 16 having a first diameter. The hub is also formed with a circular intermediate extent 18 having a second diameter less than the first diameter. The hub is further formed with a circular upper extent 20 having a third diameter less than the second diameter. A downwardly extending cylindrical hole 22 is formed in the upper extent of the hub. The hub and the hole have a common central axis.

Next provided is a circular disk 26. The circular disk has an upper surface with indicia 28. The circular disk also has a lower surface with a securement component 30. The securement component is chosen from the class of securement components including adhesives and magnets. The circular disk has a hole 32 with a diameter essentially equal to the second diameter for being received by the hub with the lower surface of the disk on the lower extent of the hub.

A square backing sheet 36 is next provided. The backing sheet removably receives the disk. The securement component secures the disk to the sheet until separated by a user. The securement component is then adapted to temporarily secure the disk to a recipient surface, such as an air-conditioner, a refrigerator, a bathroom mirror, a notebook or the like.

Next, a first pointer 40 is provided. The first pointer has a first exterior free end 42 and a first interior securement ring 44. The free end and the first interior securement ring are separated by a first length. The first interior securement ring has an interior diameter essentially equal to the third diameter. The first interior securement ring has an exterior diameter essentially equal to the second diameter. The first interior securement ring is in sliding contact with the intermediate extent of the hub. The first interior securement ring has a first radial slot 46 to facilitate positioning and rotation of the first pointer.

Next, a second pointer 50 is provided. The second pointer has a second exterior free end 52 and a second interior securement ring 54. The second exterior free end and the second interior securement ring are separated by a second length which is less than the first length. The second interior securement ring has an interior diameter essentially equal to the third diameter. The second interior securement ring has an exterior diameter essentially equal to the second diameter. The second securement ring has a downwardly extending cylindrical projection 56 in sliding contact with the first pointer. The second securement ring has a second radial slot 58 to facilitate positioning and rotation of the second pointer.

Next, a third pointer 62 is provided. The third pointer has a third exterior free end 64 and a third interior securement ring 66. The third exterior free end and the third interior securement ring are separated by a third length which is less than the second length. The third interior securement ring has an interior diameter essentially equal to the third diameter. The third interior securement ring has an exterior diameter essentially equal to the second diameter. The third securement ring has a downwardly extending cylindrical projection 68 in sliding contact with the second pointer. The third securement ring has a third radial slot 70 to facilitate positioning and rotation of the third pointer.

Lastly, a keeper pin 74 is provided. The keeper pin has a cylindrical lower section 76 frictionally received in the cylindrical hole of the hub. The keeper pin also has an enlarged shoulder 78 with a diameter essentially equal to the exterior diameter of the third securement ring.

FIG. 4A-*h* shows the front view of a disc with a hole in the center. When printed or engraved, it is the face of a manually-operated instrument. The back of the face is coated with an adhesive or magnetic material which allows it to be stuck or unstuck on a flat surface.

FIG. 4A-*e* shows the side view of the face.

FIG. 4A-*g* shows the backing material that holds the disc until the instrument is ready to be used by peeling it off.

FIG. 4A-*f* is a hub that is attached in the center of 4A-*h*. The hub has a hole in the center for a retainer pin.

FIGS. 4A-*b*, 4A-*c*, 4A-*d* are the top, bottom, and side view of a pointer. The hole in the center is slightly smaller than the small part of the hub shown in the FIG. 4A-*f* that it is pressed onto. The pointer ring has a gap in it that expands when the pointer is pressed onto the hub. The gap allows the pointer to turn easily while creating enough friction so that the pointer will not turn on its own or freewheel. This allows the pointer to stay where it is set. The pointer has a projection on the bottom which allows the pointer to pass over other pointers when more than one pointer is necessary and it rotates on the elevated rim of the hub preventing the pointers from scratching or tearing the face.

FIG. 4A-*a* is a retainer pin and cap that is pressed on the hub 4A-*f* keeping the pointers on.

This completes the description of the part of the instrument that is applicable to all of the instruments described hereafter and is not repeated.

FIG. 4A-1 is a reminder instrument shown on the backing material. This instrument is used to keep contact lenses users informed and to remind them of the next contact lenses change. It is not limited to a monthly reminder instrument. It can be used as a daily, weekly, and bi-weekly reminder instrument. FIG. 4A-*j* shows the reminder instrument after it is peeled off the backing material. The pointers are set by the user turning them with an index finger. This reminder instrument has two pointers. The long pointer points to the day of the month and the short pointer points to the month—one month from the day the contact lenses were put in, thereby displaying the date for the next contact lenses.

FIG. 5A-1 is a reminder instrument shown on the backing material. It is a seven-day instrument used to remind patients when the next dosage of medication is due, when the medication is prescribed to be given once a week. FIG. 5A-*b* shows the reminder instrument after it is peeled off the backing material. The pointers are set by the user turning them with an index finger. This reminder instrument has two pointers. The small pointer is set on the day of the week and the large pointer is set on the week of the month, one week from the date the medication is given, thereby indicating the next week of the month and day that the next medication is due.

FIG. 6A-*a* is a reminder instrument shown on the backing material. It is a semi-weekly instrument used to keep patients informed and remind them when the next dosage of medication is due, when the medication is prescribed to be given twice a week.

FIG. 6A-*b* shows the reminder instrument after it is peeled off the backing material.

The pointers are set by a user turning them with an index finger. This reminder instrument has three pointers. The small pointers are set on the two days the patient is to take the medication, one pointer on each day. Each time the patient takes the medication the large pointer is set on that day, thereby indicating the medication was taken.

FIG. 7A-*a* is a reminder instrument shown on the backing material. This is a twenty-eight-day cycle instrument used to keep female patients informed and to remind them to install and remove a birth control device. FIG. 7A-*b* shows the reminder instrument after it is peeled off the backing material. The pointers are set by the user turning them with an index finger. This reminder instrument has two pointers. The user sets the small pointer on the day of the month and the large pointer on the month when installing a new device. The user counts twenty-one days forward and resets the pointers indicating the date to remove the device. After removing the device, the user counts seven days forward from that date and resets the pointers. This setting indicates the month and day for a new device and to start a new cycle. When setting the dates for this reminder, it is important for the user to remember the number of days in the month, so this is listed under each month.

FIG. 8A-*a* is a reminder instrument shown on the backing material. It is a daily reminder instrument used to keep patients informed and to remind them when the next dosage of medication is due, when the medication is prescribed to be given daily. FIG. 8A-*b* shows the reminder instrument after it is peeled off the backing material. The pointers are set by the user turning them with an index finger. This reminder instrument has three pointers. To indicate when the next dose of medication is due, the user sets the large pointer on the day of the month, the medium pointer on the time of day and the small pointer on AM or PM.

FIG. 9A-1 is a reminder instrument shown on the backing material. It is an instrument that is used to keep women informed and to remind them when the next breast self-examination is due. FIG. 9A-*b* shows the reminder instrument after it is peeled off the backing material. The pointers are set by the user turning them with an index finger. This reminder instrument has two pointers. The long pointer points to the day of the month and the short pointer points to the month, one month from the day the self-breast examination was performed, thereby displaying the date for the next examination.

FIG. 10A-*a* is a reminder instrument shown on the backing material. It is an instrument to be used to keep pet owners informed and to remind them of the next dosage for flea and heartworm medication. FIG. 10A-*b* shows the reminder instrument after it is peeled off the backing material. The pointers are set by the user turning them with an index finger. The reminder instrument has two pointers. The long pointer points to the day of the month and the short one points to the month, one month from the day the pet was given the medication, thereby displaying the date for the next dosage.

FIG. 11A-*a* is a reminder instrument shown on the backing material. It is an instrument to be used to keep people informed and to remind them of the next air conditioning and heater filter change. FIG. 11A-*b* shows the reminder instrument after it is peeled off the backing material. The pointers are set by the user turning them with an index finger. The reminder instrument has two pointers. The long pointer points to the day of the month and the short pointer points to the month. The user sets the pointers on the month and day the filter is scheduled to be changed, predicated on the number of months the manufacturer recommends the filter to be used, thereby displaying the date for the next air conditioning and heater filter change.

FIG. 12A-*a* is a reminder instrument shown on the backing material. This instrument is used to keep people informed whether the dishes remaining in the dish washer are dirty or clean, after the cycle has finished and the door has been opened and the clean light on the dishwasher is extinguished. FIG. 12A-*b* shows the reminder instrument after it is peeled off the backing material. The pointer is set by the user turning it with an index finger. This reminder instrument has one pointer. The pointer is set on clean after the dishes are washed and the door has been opened and remains there until all of the dishes have been unloaded. The pointer is set on dirty when the dishes are being loaded and remains there until the dishes are washed, thereby displaying whether the dishes in the washer are clean or dirty.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An event reminder system (10) for reminding a user of the time for an upcoming event, the system comprising, in combination:

a cylindrical hub (14) formed with a circular lower extent (16) having a first diameter and with a circular intermediate extent (18) having a second diameter less than the first diameter and with a circular upper extent (20) having a third diameter less than the second diameter, a downwardly extending cylindrical hole (22) formed in the upper extent of the hub, the hub and the hole having a common central axis;

a circular disk (26) having an upper surface with indicia (28) and having a lower surface with a securement component (30), the circular disk having a hole (32) with a diameter essentially equal to the second diameter for being received by the hub with the lower surface of the disk on the lower extent of the hub, the indicia including days and months and time;

a rectangular backing sheet (36) removably receiving the disk with the securement component securing the disk to the sheet until separated by a user, the securement component then adapted to temporarily secure the disk to a recipient surface;

a first pointer (40) having a first exterior free end (42) and a first interior securement ring (44) separated by a first length, the first interior securement ring having an interior diameter essentially equal to the third diameter and having an exterior diameter essentially equal to the second diameter, the first interior securement ring being in sliding contact with the intermediate extent of the hub, the first interior securement ring having a first radial slot (46) to facilitate positioning and rotation of the first pointer to point to a time;

a second pointer (50) having a second exterior free end (52) and a second interior securement ring (54) separated by a second length less than the first length, the second interior securement ring having an interior diameter essentially equal to the third diameter and an exterior diameter essentially equal to the second diameter, the second securement ring having a downwardly extending cylindrical projection (56) in sliding contact with the first pointer, the second securement ring having a second radial slot (58) to facilitate positioning and rotation of the second pointer to point at a month;

a third pointer (62) having a third exterior free end (64) and a third interior securement ring (66) separated by a third length less than the second length, the third interior securement ring having an interior diameter essentially equal to the third diameter and an exterior diameter essentially equal to the second diameter, the third securement ring having a downwardly extending cylindrical projection (68) in sliding contact with the second pointer, the third securement ring having a third radial slot (70) to facilitate positioning and rotation of the third pointer to point at a day; and a keeper pin (74) with a cylindrical lower section (76) frictionally received in the cylindrical hole of the hub, the keeper pin having an enlarged shoulder (78) with a diameter essentially equal to the exterior diameter of the third securement ring.

* * * * *